US010185254B2

(12) United States Patent
Hirai et al.

(10) Patent No.: US 10,185,254 B2
(45) Date of Patent: Jan. 22, 2019

(54) IMAGE FORMING APPARATUS THAT OBTAINS LIFETIME OF SECONDARY TRANSFER MEMBER

(71) Applicant: CANON KABUSHIKI KAISHA, Tokyo (JP)

(72) Inventors: Masahide Hirai, Numazu (JP); Ryosuke Hamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/855,365

(22) Filed: Dec. 27, 2017

(65) Prior Publication Data

US 2018/0210376 A1 Jul. 26, 2018

(30) Foreign Application Priority Data

Jan. 20, 2017 (JP) ..... 2017-008551

(51) Int. Cl.
*G03G 15/16* (2006.01)

(52) U.S. Cl.
CPC ..... *G03G 15/1665* (2013.01); *G03G 15/1605* (2013.01)

(58) Field of Classification Search
CPC ..... G03G 15/1605; G03G 15/161; G03G 15/1665; G03G 15/553; G03G 21/168; G03G 21/1875; G03G 2221/1642; G03G 2221/1663
USPC ..... 399/24, 31, 66, 121
See application file for complete search history.

(56) References Cited

U.S. PATENT DOCUMENTS 6,600,895 B2 * 7/2003 Fletcher et al. ..... G03G 15/161 399/307
7,016,618 B2 * 3/2006 Jeong ..... G03G 15/553 399/24
8,626,026 B2 * 1/2014 Yoshikawa ..... G03G 15/161 399/121
8,831,452 B2 * 9/2014 Yamada ..... G03G 15/1605 399/66

FOREIGN PATENT DOCUMENTS

JP 2003-195700 A 7/2003
JP 2004-354513 A 12/2004
JP 2010-026189 A 2/2010
JP 2015-038577 A 2/2015

* cited by examiner

*Primary Examiner* — William J Royer
(74) *Attorney, Agent, or Firm* — Venable LLP

(57) ABSTRACT

An image forming apparatus includes a detection unit configured to obtain information with regard to the life of a secondary transfer member based on the variation in an electric resistance value of a secondary transfer portion, wherein the detection unit performs a process of reducing the effect of variation in the electric resistance value of an intermediate transfer member contained in the variation in the electric resistance value of the secondary transfer portion, based on a detection result of information with regard to the electric resistance value of the secondary transfer portion by a second detection unit, and on a detection result of information with regard to an electric resistance value of a primary transfer portion by a first detection unit, and obtains the information with regard to the life of the secondary transfer member.

15 Claims, 10 Drawing Sheets

IMAGE FORMING APPARATUS THAT OBTAINS LIFETIME OF SECONDARY TRANSFER MEMBER

BACKGROUND OF THE INVENTION

Field of the Invention

The present invention relates to image forming apparatuses, such as a copier, a printer and a facsimile apparatus, which use electrophotographic and electrostatic recording schemes.

Description of the Related Art

Conventionally, image forming apparatuses that use the electrophotographic scheme and the like include an image forming apparatus of an intermediate transfer scheme where an image is output by secondarily transferring, onto a transfer material, a toner image having been transferred from an image bearing member onto an intermediate transfer member. An intermediate transfer belt that has an endless-belt shape is widely adopted as the intermediate transfer member. Each of primary transfer and secondary transfer is performed by applying a voltage to a transfer member disposed in contact with the intermediate transfer belt and by supplying transfer current in many cases. Transfer rollers (a primary transfer roller and a secondary transfer roller) which are roller-shaped transfer members are widely adopted as a primary transfer member and a secondary transfer member.

In such an image forming apparatus, the electric resistance value of the transfer roller tends to increase with increase in the amount of use of the transfer roller owing to the variation in the state of a conductive material and adhesion of dust, such as paper powder. When the electric resistance value increases to an acceptable range or more, a transfer failure due to shortage of transfer current sometimes occurs. Accordingly, when the life is set based on the index value of the amount of use, such as the printing sheet number or the total rotation time, and the index value reaches a value corresponding to the life, a transfer roller or a unit that includes the transfer roller is recommended to be replaced in some cases. However, the degree of increase in the electric resistance value of the transfer roller is different with the usage situations (the difference in the transfer members or the difference in output images) of the image forming apparatus. Consequently, when the life is uniformly determined based on the index value of the amount of use of the transfer roller, it is difficult to determine the life of the transfer roller correctly. Replacement of the transfer roller that has not reached the life yet in actuality sometimes causes unnecessary maintenance cost, and continuous use of the transfer roller having reached the life in actuality sometimes causes a transfer failure.

Japanese Patent Application Laid-Open No. 2003-195700 proposes that the electric resistance value of a transfer roller be measured, and if the electric resistance value is out of an acceptable range, it is determined that the life of the transfer roller or a unit that includes the transfer roller is reached.

SUMMARY OF THE INVENTION

An aspect of the present invention is an image forming apparatus capable of improving the accuracy of determination of the life of the secondary transfer member to maintain the output of a favorable image, and facilitating reduction in maintenance cost.

Another aspect of the present invention is an image forming apparatus including an image bearing member configured to bear a toner image, an intermediate transfer member configured to convey the toner image primarily transferred from the image bearing member for secondary transfer onto a transfer material, a primary transfer member configured to primarily transfer the toner image from the image bearing member onto the intermediate transfer member at a primary transfer portion, a secondary transfer member configured to secondarily transfer the toner image from the intermediate transfer member onto the transfer material at a secondary transfer portion, a first power supply configured to apply a voltage to the primary transfer member, a second power supply configured to apply a voltage to the secondary transfer member, a first detection unit configured to detect information based on a current value and a voltage value in a case of application of the voltage to the primary transfer member by the first power supply, a second detection unit configured to detect information based on a current value and a voltage value in a case of application of the voltage to the secondary transfer member by the second power supply; and a detection unit configured to obtain information with regard to a life of the secondary transfer member based on a detection result by the second detection unit, wherein the detection unit takes advantage of a detection result by the first detection unit to obtain the information with regard to the life of the secondary transfer member.

Another aspect of the present invention is an image forming apparatus including an image bearing member configured to bear a toner image, an intermediate transfer member configured to convey the toner image having been primarily transferred from the image bearing member for secondary transfer onto a transfer material, a primary transfer member configured to primarily transfer the toner image from the image bearing member onto the intermediate transfer member at a primary transfer portion, a secondary transfer member configured to secondarily transfer the toner image from the intermediate transfer member onto the transfer material at a secondary transfer portion, a first power supply configured to apply a voltage to the primary transfer member, a second power supply configured to apply a voltage to the secondary transfer member, a first detection unit configured to detect information based on a current value and a voltage value in a case of application of the voltage to the primary transfer member by the first power supply, a second detection unit configured to detect information based on a current value and a voltage value in a case of application of the voltage to the secondary transfer member by the second power supply, and a notification unit configured to notify information, wherein the notification unit is configured to notify the information with regard to the life of the secondary transfer member according to results by the first detection unit and the second detection unit.

A further aspect of the present invention is an image forming apparatus including an image bearing member configured to bear a toner image, an intermediate transfer member configured to convey the toner image primarily transferred from the image bearing member for secondary transfer onto a transfer material, a primary transfer member configured to primarily transfer the toner image from the image bearing member onto the intermediate transfer member at a primary transfer portion, a secondary transfer member configured to secondarily transfer the toner image from the intermediate transfer member onto the transfer material at a secondary transfer portion, a first power supply configured to apply a voltage to the primary transfer member, a second power supply configured to apply a voltage to the secondary transfer member, a first detection unit configured to detect information based on a current value and a voltage value in a case of application of the voltage to the primary transfer member by the first power supply, a second detection unit configured to detect information based on a current value and a voltage value in a case of application of the voltage to the secondary transfer member by the second power supply, and a communicating unit configured to transmit information to an external device outside the image forming apparatus, wherein the communicating unit is configured to transmit the information with regard to the life of the secondary transfer member to the external device according to results by the first detection unit and the second detection unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, an image forming apparatus according to the present invention is described further in detail with reference to the drawings.

Embodiment 1

1. Overall Configuration and Operation of Image Forming Apparatus

Figure 1:
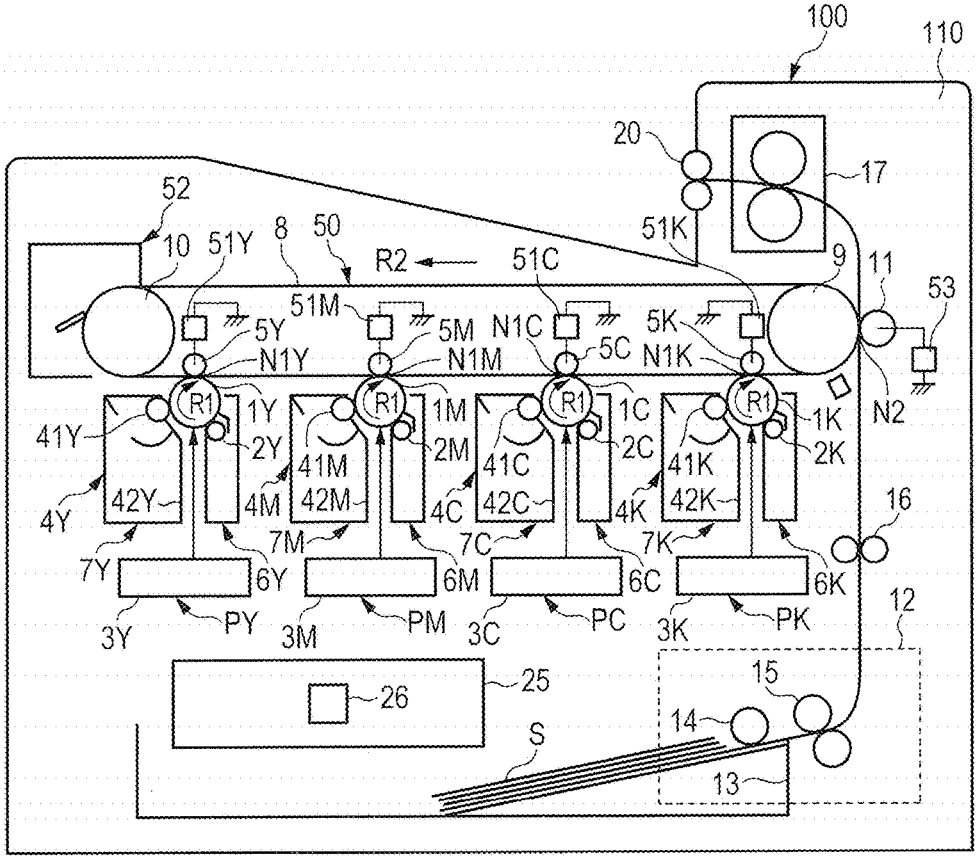
FIG. 1 is a schematic sectional view of an image forming apparatus.

FIG. 1 is a schematic sectional view of an image forming apparatus 100 of this embodiment. The image forming apparatus 100 of this embodiment is a tandem type image forming apparatus (laser beam printer) that adopts an intermediate transfer scheme capable of forming a full-color image using an electrophotographic scheme. The image forming apparatus 100 includes multiple image forming units, which are first, second, third and fourth image forming units PY, PM, PC and PK that can form yellow (Y), magenta (M), cyan (C) and black (K) toner images, respectively. In this embodiment, the configurations and operations of the image forming units PY, PM, PC and PK are substantially identical to each other except the difference in the colors of the toner used in a development step, described later. Accordingly, in a case where discrimination is not specifically required, the last letters Y, M, C and K of the symbols that indicate the elements for specific colors are omitted, and the elements are comprehensively described. In this embodiment, an image forming unit P includes a photosensitive drum 1, a charge roller 2, an exposure device 3, a development device 4, a primary transfer roller 5 and a drum cleaner 6.

The photosensitive drum 1, which is a drum-shaped electrophotographic photosensitive member (photosensitive member) as an image bearing member, is rotationally driven in an R1 direction (clockwise) in the diagram at a predetermined circumferential velocity (process speed). The surface of the rotating photosensitive drum 1 is subjected to a charging process and uniformly charged to a predetermined potential having a predetermined polarity (negative polarity in this embodiment) by the charge roller 2, which is a roller-shaped charging member as a charging unit. During the charging process, a predetermined charging voltage (charging bias) is applied to the charge roller 2. The surface of the photosensitive drum 1 having been subjected to the charging process is scanned and exposed to light based on an image signal by the exposure device (laser scanner unit) 3 as an exposure unit, and an electrostatic latent image (electrostatic image) is formed on the photosensitive drum 1. The electrostatic latent image formed on the photosensitive drum 1 is developed (visualized) by the development device 4 as a development unit using toner as developer, and a toner image is formed on the photosensitive drum 1. The development device 4 includes a development roller 41 as a developer bearing member, and a toner container 42 that contains toner. During development, a predetermined development voltage (development bias) is applied to the development roller 41. In this embodiment, the toner charged to have the same polarity (negative polarity in this embodiment) as the charge polarity of the photosensitive drum 1 adheres onto the exposure portion of the photosensitive drum 1 that has the reduced absolute value of the potential, by being subjected to uniform charging process and then by being exposed.

An intermediate transfer belt 8 made of an endless belt is disposed so as to face the photosensitive drum 1 of each image forming unit P. The intermediate transfer belt 8 is an example of an intermediate transfer member that conveys the toner image having been primarily transferred from the image bearing member for secondary transfer onto the transfer member. The intermediate transfer belt 8 is stretched over a driving roller 9 and a tension roller 10, which serve as tension rollers, and is thus stretched at a predetermined tensile strength. The driving roller 9 is rotationally driven, which rotates (rotationally moving) the intermediate transfer belt 8 in an arrow R2 (counterclockwise) in the diagram at a circumferential velocity (process speed) equivalent to the velocity of the photosensitive drum 1. The primary transfer roller 5, which is the roller-shaped primary transfer member serving as the primary transfer unit, is disposed on the inner surface side of the intermediate transfer belt 8 so as to correspond to each photosensitive drum 1. The primary transfer roller 5 is pressed against the photosensitive drum 1 through the intermediate transfer belt 8, and the intermediate transfer belt 8 and the photosensitive drum 1 come into contact with each other, which forms a primary transfer portion (primary transfer nip) N1. The toner image formed on the photosensitive drum 1 as described above is primarily transferred at the primary transfer portion N1 onto the intermediate transfer belt 8 that is rotating in contact with the photosensitive drum 1. During primary transfer, a primary transfer voltage (primary transfer bias) that is a direct-current voltage having a polarity (positive polarity in this embodiment) opposite to the charge polarity of the toner during development is applied to the primary transfer roller 5 by a primary transfer power supply (high voltage power supply circuit) 51 serving as a first power supply. For example, during formation of a full-color image, toner images that have colors of yellow, magenta, cyan and black and are formed on the respective photosensitive drums 1Y, 1M, 1C and 1K are consecutively primarily transferred onto the intermediate transfer belt 8 in a manner of being overlaid with each other.

A secondary transfer roller 11 that is a roller-shaped secondary transfer member serving as a secondary transfer unit is disposed at a position that is on the outer peripheral surface of the intermediate transfer belt 8 and faces the driving roller 9 that also serves as a secondary transfer opposite roller. The secondary transfer roller 11 is pressed against the driving roller 9 through the intermediate transfer belt 8, and the intermediate transfer belt 8 and the secondary transfer roller 11 come into contact with each other, which forms a secondary transfer portion (secondary transfer nip) N2. The toner image formed on the intermediate transfer belt 8 as described above is secondarily transferred onto a transfer member S, such as a recording sheet, which is clamped between the intermediate transfer belt 8 and the secondary transfer roller 11 at the secondary transfer portion N2 and is conveyed. During secondary transfer, a secondary transfer voltage (secondary transfer bias) that is a direct-current voltage having a polarity (positive polarity in this embodiment) opposite to the charge polarity of the toner during development is applied to the secondary transfer roller 11 by a secondary transfer power supply (high voltage power supply circuit) 53 serving as a second power supply. The transfer member S is contained in a container cassette 13, is fed out of the cassette 13 by a feed roller 14 of a feed and conveyance device 12, and is conveyed to a registration roller pair 16 by a conveyor roller pair 15 of the feed and conveyance device 12. The transfer member S is brought into synchronization with the toner images on the intermediate transfer belt 8 by the registration roller pair 16, and is supplied to the secondary transfer portion N2.

The transfer member S on which the toner images have been transferred is heated and pressurized by a fixing device 17 serving as a fixing unit to fix (fuse and fix) the toner images, and subsequently is ejected outside an apparatus main body 110 of the image forming apparatus 100 by an ejection roller pair 20.

The toner remaining on the photosensitive drum 1 during primary transfer (primary transfer remaining toner) is removed and collected from the photosensitive drum 1 by the drum cleaner 6 serving as a photosensitive member cleaning unit. A belt cleaner 52 serving as an intermediate transfer belt cleaning unit is disposed at a position that is on the outer peripheral surface side of the intermediate transfer belt 8 and faces the tension roller 10. The toner remaining on the intermediate transfer belt 8 during secondary transfer (secondary transfer remaining toner) is removed and collected from the intermediate transfer belt 8 by the belt cleaner 52.

In this embodiment, the intermediate transfer belt 8, the driving roller 9, the tension roller 10, the belt cleaner 52, the primary transfer rollers 5Y, 5M, 5C and 5K are configured as an intermediate transfer unit 50 to be integrally attachable and detachable to and from the apparatus main body 110.

According to this embodiment, at each image forming unit P, the photosensitive drum 1, and the charge roller 2, development device 4 and drum cleaner 6, which serve as a process unit and operate for the photosensitive drum 1, are configured as a process cartridge 7 to be integrally attachable and detachable to and from the apparatus main body 110.

2. Transfer Configuration

Next, the configuration related to the primary transfer and secondary transfer in this embodiment is described in further detail.

In this embodiment, the intermediate transfer belt 8, which can be easily reduced in size, is adopted as the intermediate transfer member. The intermediate transfer belt 8 is configured to be an endless belt that includes a resin material onto which a conductive agent has been added to have conductivity. The intermediate transfer belt 8 is stretched around the two axes, which are the driving roller 9 and the tension roller 10. A tensile strength of total pressure of 100 N is applied by the tension roller 10 to the intermediate transfer belt 8. In this embodiment, an endless belt that is formed of a polyimide resin having been adjusted to have a volume resistivity of $1 \times 10^{10}$ Ω·cm by mixing carbon as a conductive agent and has a thickness of 70 μm, is adopted as the intermediate transfer belt 8. Preferably, the volume resistivity of the intermediate transfer belt 8 ranges from $1 \times 10^{9}$ to $10^{11}$ Ω·cm in view of transfer. In a case where the volume resistivity is less than $1 \times 10^{9}$ Ω·cm, transfer failure due to the transfer current flowing away in an environment with a high temperature and high humidity sometimes occurs. On the other hand, in a case where the volume resistivity is higher than $1 \times 10^{11}$ Ω·cm, transfer failure due to abnormal discharge in an environment with a low temperature and low humidity sometimes occurs. Here, the volume resistivity is obtained by the following measurement method. That is, Hiresta-UP (MCP-HT450) by Mitsubishi Chemical Corporation is used, UR is used as a measurement probe, the indoor temperature during measurement is set to 23° C., the indoor humidity is set to 50%, and measurement is performed under a condition with an application voltage of 250 V and a measurement time of 10 sec.

In this embodiment, a polyimide resin is used as the material of the intermediate transfer belt 8. However, the material of the intermediate transfer belt 8 is not limited to this example. For example, any of the following other materials may be adopted only if the material is a thermoplastic resin. For example, materials, such as polyester, polycarbonate, polyarylate, acrylonitrile butadiene styrene copolymer (ABS), polyphenylenesulfide (PPS), polyvinylidene difluoride (PVdF), and polyethylene naphthalate (PEN), and resins in which these materials are mixed may be adopted. In this embodiment, carbon, which is a conductive agent having electronic conductivity is adopted as the conductive agent contained in the material of the intermediate transfer belt 8. However, the material is not limited to this example. The conductive agent having electronic conductivity is not limited to carbon. Alternatively, a conductive metal oxide or the like may be adopted, for example. Alternatively, a conductive agent having ion conductivity may be adopted as the conductive agent. The conductive agent having ion conductivity may be, for example, any of multivalent metal salt, and quaternary ammonium salt. In the quaternary ammonium salt, the cationic part may be any of tetraethylammonium ion, tetrapropylammonium ion, tetraisopropyl ammonium ion, tetrabutylammonium ion, tetrapentylammonium ion, tetrahexylammonium ion and the like, and the anionic part may be any of halide ion, and fluoroalkyl sulfate ion, fluoroalkyl sulfite ion, and fluoroalkyl borate ion, whose fluoroalkyl group has a carbon number ranging from one to ten. The intermediate transfer belt 8 may have a configuration that mainly includes polyetheresteramide resin, and also includes potassium perfluorobutanesulfonate added to the resin.

In this embodiment, an elastic roller that includes a core (core material) covered with an elastic layer made of an elastic material and has an outer diameter of 12 mm, is adopted as the primary transfer roller 5. A nickel-plated steel bar having an outer diameter of 6 mm is adopted as the core. A foamed sponge body that includes main components which are NBR and epichlorohydrin rubber of which the volume resistivity is adjusted to an extent ranging from $1\times10^5$ to $1\times10^7$ Ω·cm, and has a thickness of 3 mm, is adopted as the elastic layer. The conductive agent having electronic conductivity and the conductive agent having ion conductivity, analogous to any of the agents which are described above, can be adopted as the conductive agent contained in the material of the elastic layer. In this embodiment, the material of the elastic layer of the primary transfer roller 5 contains carbon, which is the conductive agent having electronic conductivity, and the conductive mode of the primary transfer roller 5 is electronically conductive. The primary transfer roller 5 comes into contact with the photosensitive drum 1 through the intermediate transfer belt 8 at a pressing force of 9.8 N, and is driven by the rotation of the intermediate transfer belt 8. During primary transfer, a direct-current voltage in an extent ranging from +1,500 to +2,000 V is applied as the primary transfer voltage to the primary transfer roller 5.

In this embodiment, an elastic roller that includes a core (core material) covered with an elastic layer made of an elastic material and has an outer diameter of 18 mm, is adopted as the secondary transfer roller 11. A nickel-plated steel bar having an outer diameter of 8 mm is adopted as the core. A foamed sponge body that includes main components which are NBR and epichlorohydrin rubber of which the volume resistivity is adjusted to about $1\times10^8$ Ω·cm, and has a thickness of 5 mm, is adopted as the elastic layer. The conductive agent having electronic conductivity and the conductive agent having ion conductivity, analogous to any of the agents which are described above, can be adopted as the conductive agent contained in the material of the elastic layer. In this embodiment, the material of the elastic layer of the secondary transfer roller 11 contains carbon, which is the conductive agent having electronic conductivity, and the conductive mode of the secondary transfer roller 11 is electronic conductivity. The secondary transfer roller 11 comes into contact with the driving roller 9 through the intermediate transfer belt 8 at a pressing force of 50 N, and is driven by the rotation of the intermediate transfer belt 8. During secondary transfer, a direct-current voltage in an extent ranging from +2,500 to +5,000 V is applied as the secondary transfer voltage to the secondary transfer roller 11.

Here, the values of the primary transfer voltage and the secondary transfer voltage are to be appropriately set in conformity with the material of the belt, the material of the roller, and the apparatus configuration. The values are not limited to the values in this embodiment.

3. Control Mode

Figure 15:
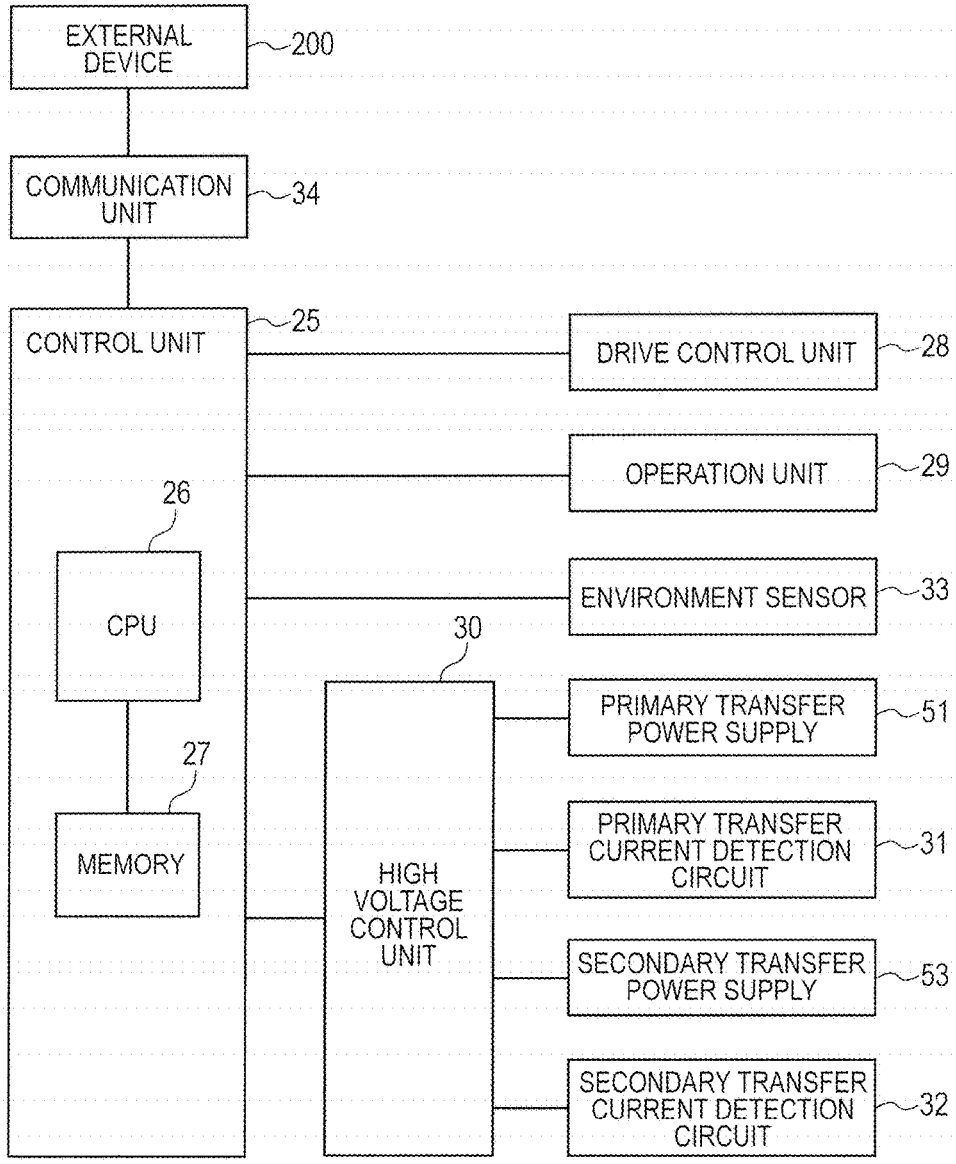
FIG. 15 is a schematic block diagram illustrating a control mode of a main part of the image forming apparatus.

FIG. 15 is a block diagram illustrating the control mode of the main part of the image forming apparatus 100 of this embodiment. The apparatus main body 110 is provided with a control unit (control board) 25 mounted with an electric circuit for controlling the image forming apparatus 100. The control unit 25 is mounted with a CPU 26 as a control device, and a memory 27 made of a ROM and a RAM as a storing unit. The CPU 26 comprehensively controls each unit of the image forming apparatus 100, according to an algorithm (program) stored in the memory 27, based on signals from various sensors provided for the apparatus main body 110.

A drive control unit 28 is connected to the control unit 25. The control unit 25 is connected, through a high voltage control unit 30, with a primary transfer power supply 51, a primary transfer current detection circuit (first current detection circuit) 31 as a current detection unit, a secondary transfer power supply 53, and a secondary transfer current detection circuit (second current detection circuit) 32 as a current detection unit. The control unit 25 is connected with an environment sensor (temperature and humidity sensor) 33 that detects the temperature and humidity of the inside of the apparatus main body 110, as an environment detection unit that detects at least one of the temperature and humidity of at least one of the inside and outside of the apparatus main body 110. The control unit 25 is connected with an operation unit 29 provided for the apparatus main body 110. The operation unit 29 is provided with keys as an input unit through which various settings related to image formation are input into the control unit 25, and with a display panel as a display unit for displaying information for an operator, such as a user and a service person.

The drive control unit 28 controls a drive source (not illustrated) related to the conveyance of the transfer member S, the drive sources of the intermediate transfer belt 8 and each image forming unit P (not illustrated), under instructions by the control unit 25. The high voltage control unit 30 controls the primary transfer voltage applied to the primary transfer roller 5, and the secondary transfer voltage applied to the secondary transfer roller 11, based on signals from the first and second current detection circuits 31 and 32 and the environment sensor 33, under instructions by the control unit 25. The control unit 25 executes life detection control that obtains information with regard to the life of the secondary transfer roller 11, based on the output value of the high voltage control unit 30, the detection results of the first and second current detection circuits 31 and 32, and the detection result of the environment sensor 33, and notifies the operator of the information. In this embodiment, the first current detection circuit 31 and the high voltage control unit 30 constitute a first detection unit that detects information with regard to the electric resistance value of the primary transfer portion based on the current value and voltage value in a case where the voltage is applied by the first power supply 51 to the primary transfer member 5. In this embodiment, the second current detection circuit 32 and the high voltage control unit 30 constitute a second detection unit that detects information with regard to the electric resistance value of the secondary transfer portion N2 based on the current value and voltage value in a case where the voltage is applied by the second power supply 53 to the secondary transfer member 11.

Here, the image forming apparatus 100 executes a series of image output operations (jobs and print operations) that is started by one start instruction and forms an image on one or more transfer members S and outputs the image. Typically, the job includes an image forming step, a pre-rotation step, an inter-sheet step in a case where images are formed on multiple transfer members S, and a post-rotation step. The image forming step spans a time period in which the electrostatic latent image of the image to be formed on the transfer member S and output in actuality is formed, the toner image is formed, and the primary transfer and secondary transfer of the toner image are performed. An image formation time is this time period. In further detail, the timings at the image formation are different with the positions at which the steps of the formation of the electrostatic latent image, the formation of the toner image, and the primary transfer and secondary transfer of the toner image are performed. The pre-rotation step spans a time period in which a preliminary operation before the image forming step is performed and which ranges from input of the start instruction to actual formation of the image. The inter-sheet step spans a time period corresponding to an interval between a transfer member S and another transfer member S in a case where image formation on multiple transfer members S is consecutively executed (consecutive image formation). The post-rotation step spans a time period in which an organizing operation (preliminary operation) after the image forming step is performed. The non-image formation time is the time period other than the image formation time, and includes the pre-rotation step, the inter-sheet step and the post-rotation step, and further includes the pre-multi-rotation step that is preliminary operation at the time of power activation of the image forming apparatus 100 or at the time of return from a sleep state.

In this embodiment, the primary transfer voltage applied by the primary transfer power supply 51 to the primary transfer roller 5 during primary transfer is controlled by a method called as Auto Transfer Voltage Control (ATVC). That is, for example, a target current value of the primary transfer current that can achieve optimal primary transfer in each of environments with specific temperatures and humidity is preset. The voltage applied from the primary transfer power supply 51 to the primary transfer roller 5 is subjected to constant current control so as to cause the current value detected by the first current detection circuit 31 to be the target current value during the non-image formation time. The output voltage value of the primary transfer power supply 51 at this time is stored. The primary transfer voltage applied from the primary transfer power supply 51 to the primary transfer roller 5 during primary transfer is subjected to constant voltage control with the stored voltage value. In this embodiment, the control of the primary transfer voltage by the ATVC is performed in the pre-rotation step (before the developed toner image reaches the primary transfer portion N1) that is for each job and is in the non-image formation time.

In this embodiment, the secondary transfer voltage applied by the secondary transfer power supply 53 to the secondary transfer roller 11 during secondary transfer is controlled by the ATVC, as with the control of the primary transfer voltage. That is, for example, a target current value of the secondary transfer current that can achieve optimal secondary transfer in each of environments with specific temperatures and humidity is preset. The voltage applied from the secondary transfer power supply 53 to the secondary transfer roller 11 is subjected to constant current control so as to cause the current value detected by the second current detection circuit 32 to be the target current value during the non-image formation time. The output voltage value of the secondary transfer power supply 53 at this time is stored. The secondary transfer voltage applied from the secondary transfer power supply 53 to the secondary transfer roller 11 during secondary transfer is subjected to constant voltage control with the stored voltage value. In this embodiment, the control of the secondary transfer voltage by the ATVC is performed in the pre-rotation step (before the transfer member S reaches the secondary transfer portion N2) that is for each job and is in the non-image formation time.

4. Life Detection Control 4-1. Overview of Life Detection Control

Next, the overview of life detection control for the secondary transfer roller 11 is described. The life of the secondary transfer roller 11 can be determined based on the variation in the electric resistance value of the secondary transfer portion N2. Although the details of the life detection control in this embodiment are described later, the determination of the life of the secondary transfer roller 11 can be performed in the following manner in a schematic view. That is, the detection result of the electric resistance value of the secondary transfer portion N2 detected at every predetermined timing is stored in the memory 27. At this time, information with regard to the amount of use, such as the printing sheet number, the total rotation time, and the voltage application time, from the brand-new state (use start time) of the secondary transfer roller 11, may be stored in the memory 27 at the same time. Accordingly, the temporal variation in the electric resistance value of the secondary transfer portion N2 with increase in the amount of use of the secondary transfer roller 11 can be grasped. A predetermined threshold (upper limit setting value) corresponding to the life (the upper limit of the variation in electric resistance value) of the secondary transfer roller preset so as to maintain the output of a favorable image is compared with the current electric resistance value of the secondary transfer portion N2. For example, the information with regard to the life of the secondary transfer roller 11 (the life state, such as the remaining life) is notified to the operator at every predetermined timing. Instead of or in addition to the notification at every predetermined timing described above, a warning may be issued; the warning is for recommending replacement of the secondary transfer roller 11 in a case where the secondary transfer roller 11 reaches the life or for recommending preparing replacement in a case where the state approaches the life.

In this embodiment, detection of the electric resistance value of the secondary transfer portion N2 is performed when the transfer voltage control (ATVC) in the pre-rotation step is performed. The CPU 26 calculates the electric resistance value R, from the voltage V applied to the secondary transfer roller 11 during execution of the transfer voltage control (ATVC) and the current I detected by the second current detection circuit 32, based on the following Expression (1).

$$R=V/I \quad \text{Expression (1)}$$

To reduce the effect of the variation in environment and detect a more correct electric resistance value, the CPU 26 obtains a corrected resistance value R' that is an electric resistance value obtained by correction against the amount of variation in environment of the electric resistance value R obtained from the Expression (1). More specifically, the CPU 26 obtains the absolute water amount of the setting environment of the image forming apparatus 100, based on the temperature and humidity detected by the environment sensor 33. The CPU 26 calculates the corrected resistance value R', based on the relational expression between the absolute water amount and electric resistance value preliminarily obtained in the following Expression (2). The CPU 26 stores the obtained corrected resistance value R', as information with regard to the electric resistance value of the secondary transfer portion N2, in the memory 27.

$$R'=R+k(1.1-Z) \quad \text{k: environment correction coefficient, Z: absolute water amount} \quad \text{(Expression 2)}$$

Figure 2:
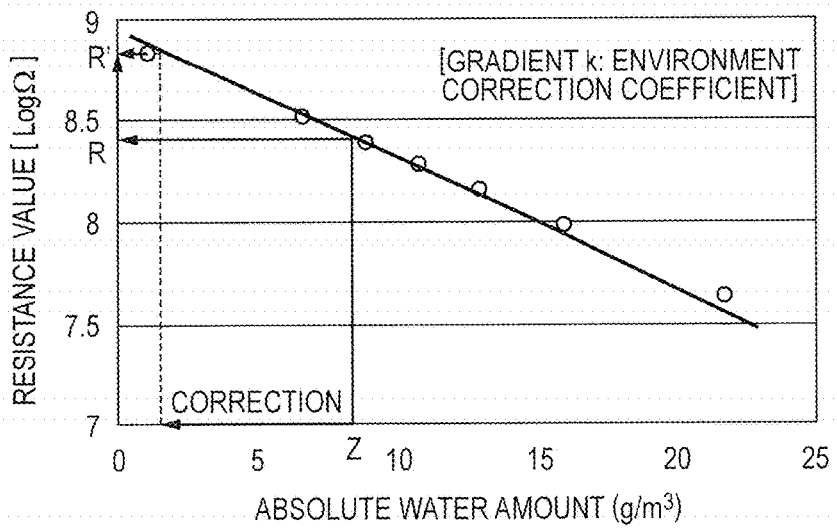
FIG. 2 is a graph for illustrating an environment variation correction for an electric resistance value.

FIG. 2 is a graph illustrating the relationship between the absolute water amount and the electric resistance value of the secondary transfer portion N2. A solid line in FIG. 2 indicates the relationship between the electric resistance value R of the secondary transfer portion N2 obtained by the Expression (1) and the absolute water amount. As illustrated in FIG. 2, the electric resistance value R of the secondary transfer portion N2 substantially linearly varies with the absolute water amount. In this embodiment, as indicated by a broken line in FIG. 2, the electric resistance value R obtained by the Expression (1) is corrected by the environment correction expression of the Expression (2) to a value in a case where the absolute water amount is 1.1[g/m$^3$] in a low temperature and low humidity environment, and the corrected value is used for control.

Here, as the details described later, in this embodiment, the electric resistance value of the primary transfer portion N1 is also used for determination of the life of the secondary transfer roller 11. In this embodiment, detection of the electric resistance value of the primary transfer portion N1 is performed when the transfer voltage control (ATVC) in the pre-rotation step is performed. In this embodiment, the environment correction expression is preliminarily obtained also for the electric resistance value of the primary transfer portion N1 as with the case of the electric resistance value of the secondary transfer portion N2. The electric resistance value obtained by the Expression (1) is corrected in conformity with the absolute water amount by the environment correction expression, and is used for control.

The correction expression becomes a different correction expression in a case where the electric resistance values of the rollers and belt, the apparatus configuration, the process speed and the like are different. In this embodiment, as described above, the electric resistance value is corrected by the correction expression. Alternatively, the relationship between the absolute water amount and the electric resistance value may be preliminarily obtained as a correction table, and the value may be corrected by referring to the correction table.

Figure 3:
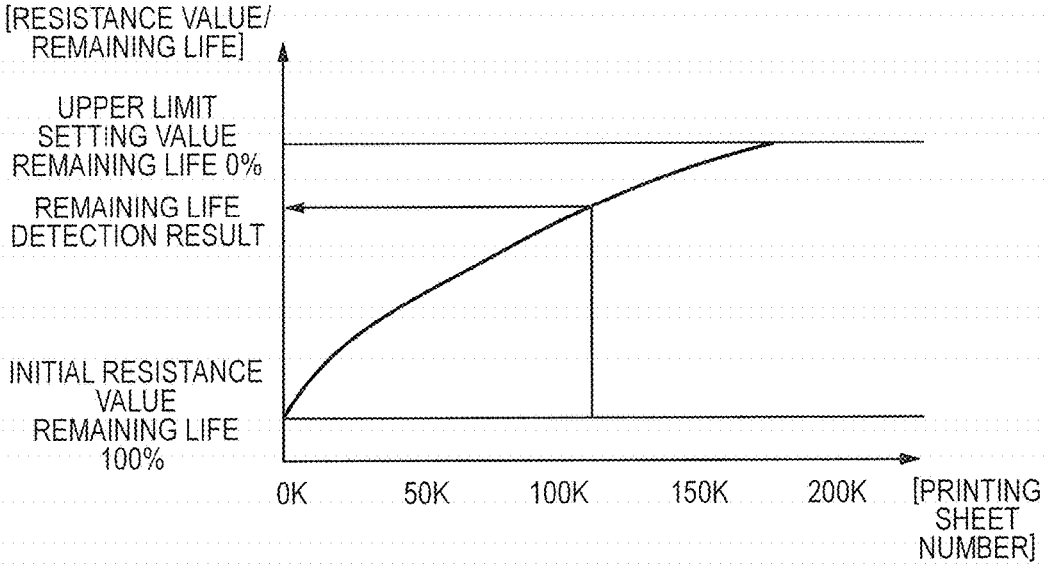
FIG. 3 is a graph for illustrating a detection of a life through measurement of the electric resistance value.

FIG. 3 is a graph illustrating a representative example of transition of the detection result of the electric resistance value of the secondary transfer portion N2 with increase in amount of use (printing sheet number) of the secondary transfer roller 11. The electric resistance value is the corrected resistance value R' after correction as described above (hereinafter, this case is analogously applicable unless specifically described). Although not limited to this case, as illustrated in FIG. 3, the electric resistance value of the secondary transfer portion N2 tends to increase with increase in the amount of use of the secondary transfer roller 11.

In this embodiment, the electric resistance value (initial resistance value) of the secondary transfer portion N2 in the brand-new state (at the use start time) of the secondary transfer roller 11 is stored in the memory 27. At each detection timing of the electric resistance value, the variation in the electric resistance value from the initial resistance value at the time is obtained. The "remaining life" that is information with regard to the life of the secondary transfer roller 11 is obtained based on the ratio of the variation to the upper limit setting value of the variation range of the preset electric resistance value. More specifically, it is assumed that the remaining life in a case where the electric resistance value is the initial resistance value is 100% and the remaining life in a case where the variation in electric resistance value reaches the preset upper limit setting value of the preset variation range is 0%, and the remaining life is obtained.

Here, the detection result of the electric resistance value of the secondary transfer portion N2 contains the electric resistance component of the secondary transfer roller 11 and the electric resistance component of the intermediate transfer belt 8. Conventionally, the life of the secondary transfer roller 11 has been determined based on the detection result of the electric resistance value of the secondary transfer portion N2 that contains the electric resistance component of the intermediate transfer belt 8. That is, the life of the secondary transfer roller 11 has been conventionally determined based on the variation in the total resistance value that contains the variation in the electric resistance value of the intermediate transfer belt and the adverse effect of increase in the electric resistance value. Accordingly, a margin in consideration of the increase in the electric resistance value of the intermediate transfer belt 8 and the variation in the initial resistance value of the intermediate transfer belt 8 itself through production has been conventionally provided, and the upper limit setting value of the variation range of the electric resistance value has been set so that the output of the favorable image can be maintained. In view of such a point, it can be recognized that, in a case where the electric resistance value of the secondary transfer roller is higher than the electric resistance value of the intermediate transfer belt 8, the accuracy of determination of the life of the secondary transfer roller 11 based on the variation in the electric resistance value of the secondary transfer portion N2 is higher than the accuracy in the inverted case.

Figure 4A:
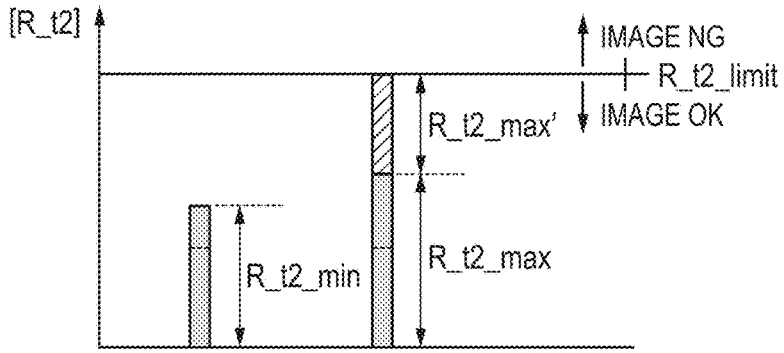
FIGS. 4A, 4B and 4C are schematic diagrams for illustrating the electric resistance value of a secondary transfer portion.
Figure 4B:
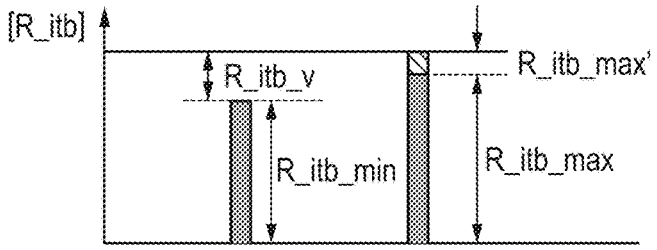
Figure 4C:
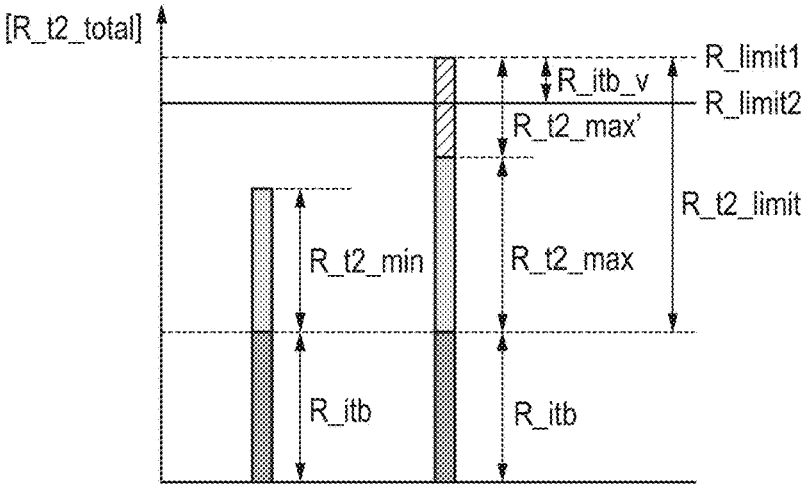

Referring to FIGS. 4A, 4B and 4C, the effects of the electric resistance value of the secondary transfer roller 11 and the electric resistance value of the intermediate transfer belt 8 to the electric resistance value of the secondary transfer portion N2 are described.

FIG. 4A is a diagram for illustrating the electric resistance component of the secondary transfer roller 11 contained in the electric resistance value of the secondary transfer portion N2. R_t2 is the electric resistance value of the secondary transfer roller 11. R_t2_min is the electric resistance value of the secondary transfer roller in the case of the production tolerance lower limit. R_t2_max is the electric resistance value of the secondary transfer roller 11 in the case of the production tolerance upper limit. R_t2_max' indicates the variation in the electric resistance value of the secondary transfer roller 11 due to increase in the amount of use in the case of the production tolerance upper limit. R_t2_limit is the upper limit setting value of the electric resistance value of the secondary transfer roller 11 set so that the output of a favorable image can be maintained. R_t2_limit is set so that the following problem can be sufficiently suppressed, for example. That is, when the increase in amount of use increases the electric resistance value of the secondary transfer roller 11, the output limit of the secondary transfer power supply 53 cannot allow the target transfer current to flow and causes a transfer failure in some cases. Even if a desired voltage can be output from the secondary transfer power supply 53 in a case where the increase in amount of use increases the electric resistance value of the secondary transfer roller 11, the voltage applied to the secondary transfer roller 11 becomes too high with the electric resistance value of the secondary transfer roller 11 excessively being increased in some cases. In this case, abnormal discharge occurs between the secondary transfer roller 11 and the intermediate transfer belt 8, and the abnormal discharge sometimes causes a local disturbance, which is called a pinhole, in the image, and retransfer of the toner image from the transfer member S to the intermediate transfer belt 8. Consequently, the aforementioned R_t2_limit is set to a value that allows determination that the secondary transfer roller 11 reaches the life before occurrence of the abnormal discharge or transfer failure as described above.

FIG. 4B is a diagram for illustrating the electric resistance component of the intermediate transfer belt 8 contained in the electric resistance value of the secondary transfer portion N2. R_itb is the electric resistance value of the intermediate transfer belt 8. R_itb_min is the electric resistance value of the intermediate transfer belt in the case of the production tolerance lower limit. R_itb_max is the electric resistance value of the intermediate transfer belt 8 in the case of the production tolerance upper limit. R_itb_max' indicates the variation in the electric resistance value of the intermediate transfer belt 8 due to increase in the amount of use in the case of the production tolerance upper limit. Although not limited to this case, the electric resistance value of the intermediate transfer belt 8 tends to increase with increase in the amount of use as with the electric resistance value of the secondary transfer roller 11. In this case, the maximum variation extent of the electric resistance value of the intermediate transfer belt 8 is R_itb_v that is the difference between R_itb_min and R_itb_max'.

FIG. 4C is a diagram for illustrating the detection result of the electric resistance value of the secondary transfer portion N2 that contains the electric resistance component of the secondary transfer roller 11 and the electric resistance component of the intermediate transfer belt 8. At the secondary transfer portion N2, the total resistance value R_t2_total that is the total sum of the electric resistance value R_t2 of the secondary transfer roller 11 and the electric resistance value R_itb of the intermediate transfer belt 8 is detected. The variation in the electric resistance of the secondary transfer roller 11 and the variation in the electric resistance of the intermediate transfer belt 8 cannot be detected in a manner discriminated from each other, from the detection result of R_t2_total. Accordingly, the following upper limit setting value has conventionally been set as the upper limit setting value of R_t2_total for determining the life of the secondary transfer roller 11. That is, the upper limit setting value R_limit2 is obtained by applying a margin as much as the amount of effect of the variation R_itb_v of the electric resistance value of the intermediate transfer belt 8 illustrated in FIG. 4B, to the upper limit setting value R_limit1 obtained from the total sum of R_itb and R_t2_limit. Accordingly, the upper limit setting value has been set so that the output of a favorable image can be maintained in consideration of the variation of the electric resistance value of the intermediate transfer belt 8.

The margin provided to have additionally a variation of the electric resistance value of the intermediate transfer belt 8 as described above leads to a favorable result in view of securing the image, i.e., maintaining the output of a favorable image. However, the secondary transfer roller 11 is replaced before the actual life is reached in some cases.

4-2. Life Detection Control in this Embodiment

In this embodiment, in view of the above problem, the life of the secondary transfer roller 11 is determined based on the detection result of the electric resistance value of the secondary transfer portion N2 and the detection result of the electric resistance value of the primary transfer portion N1. In this embodiment, when the electric resistance value of the secondary transfer portion N2 is detected for determining the life of the secondary transfer roller 11, the electric resistance value of the primary transfer portion N1 is also detected. The detection of the electric resistance value of the primary transfer portion N1 may be performed for at least one image forming unit P. The average value of the results obtained for multiple image forming units P may be adopted as the detection result. In this embodiment, the electric resistance value of the secondary transfer roller 11 is obtained by subtracting the electric resistance value of the intermediate transfer belt 8 obtained based on the detection result of the electric resistance value of the primary transfer portion N1, from the detection result of the electric resistance value of the secondary transfer portion N2. The life of the secondary transfer roller 11 is determined based on the variation of the electric resistance value of the secondary transfer roller 11 from the value in the brand-new state of the secondary transfer roller 11. Accordingly, in consideration of the variation in the electric resistance value of the intermediate transfer belt 8, the variation in the electric resistance value of the secondary transfer roller 11 that actually affects secondary transfer can be more correctly detected, and the life of the secondary transfer roller 11 can be more correctly determined. Hereinafter, further detailed description is made.

Figure 5:
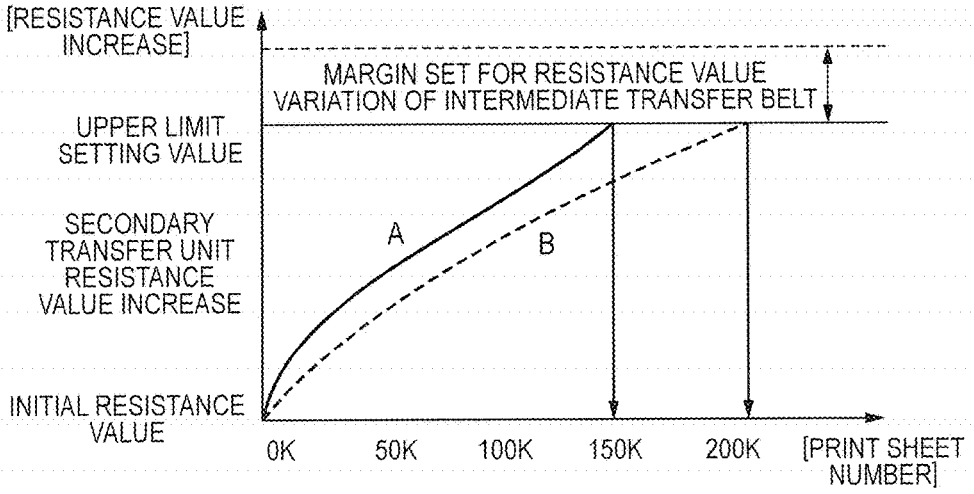
FIG. 5 is a graph illustrating an example of a detection result of the electric resistance value of the secondary transfer portion.

FIG. 5 is a graph illustrating an example of the transition of the detection result of the electric resistance value of the secondary transfer portion N2 with increase in amount of use (printing sheet number) of the secondary transfer roller 11. The abscissa axis indicates the printing sheet number. The ordinate axis indicates the variation that is from the initial resistance value and can be obtained from the detection result of the electric resistance value (hereinafter, the indication is also applied to the other diagrams indicating the transition of the electric resistance value). FIG. 5 illustrates the detection result of the electric resistance value of the secondary transfer portion N2 in a case where two types of transfer members S are adopted to compare the effects of the print conditions, and paper types. In the case where any of the two types of transfer members S is adopted, the secondary transfer roller and the intermediate transfer belt 8 that have substantially the same initial resistance values are adopted, to align the conditions other than the condition of the transfer member S. A transfer member A that has a relatively high electric resistance value and a relatively large amount of paper powder, and a transfer member B that has a relatively low electric resistance value and a relatively small amount of paper powder are adopted as the transfer members S. Use of the secondary transfer roller 11, and the intermediate transfer unit 50 that includes the intermediate transfer belt 8 and the primary transfer roller 5 was simultaneously started in the brand-new states.

Referring to FIG. 5, even in a case where the secondary transfer roller 11 and the intermediate transfer belt 8 that have substantially the same initial resistance value are adopted, it can be understood that a different transfer member S used for printing makes the electric resistance value of the secondary transfer portion N2 have a different increase gradient. In the case where the transfer member A that has a relatively high electric resistance value and a relatively large amount of paper powder is adopted, the secondary transfer roller 11 tends to be dirty with paper powder and the increase gradient of the electric resistance value tends to be large, in comparison with the case where the transfer member B is adopted. Even in the cases where the secondary transfer rollers 11 and the intermediate transfer belts 8 that have substantially the same configurations are adopted, the increase gradients of the electric resistance values of the secondary transfer portions N2 sometimes become different. Accordingly, the timings at which the electric resistance values reach the upper limit setting value are different from each other. This difference means that even in the case where the configurations of the secondary transfer rollers 11 and the intermediate transfer belts 8 are substantially identical to each other, a different condition where the image forming apparatus 100 is used, such as a difference in transfer member S, sometimes makes the timings different at which the secondary transfer roller 11 reaches the life. Here, as described above, the detection result of the electric resistance value of the secondary transfer portion N2 is the detected total resistance value of the electric resistance component of the intermediate transfer belt 8 and the electric resistance component of the secondary transfer roller 11. Accordingly, the increase in the electric resistance value of the secondary transfer roller 11 and the increase in the electric resistance value of the intermediate transfer belt 8 cannot be discriminated from each other. Consequently, as described above, the upper limit setting value (the solid line in FIG. 5) in consideration of the effect of the electric resistance value of the intermediate transfer belt 8 has conventionally been set (the range indicated by the solid line and broken line in FIG. 5 represents the maximum variation of the electric resistance value of the intermediate transfer belt 8).

Figure 6:
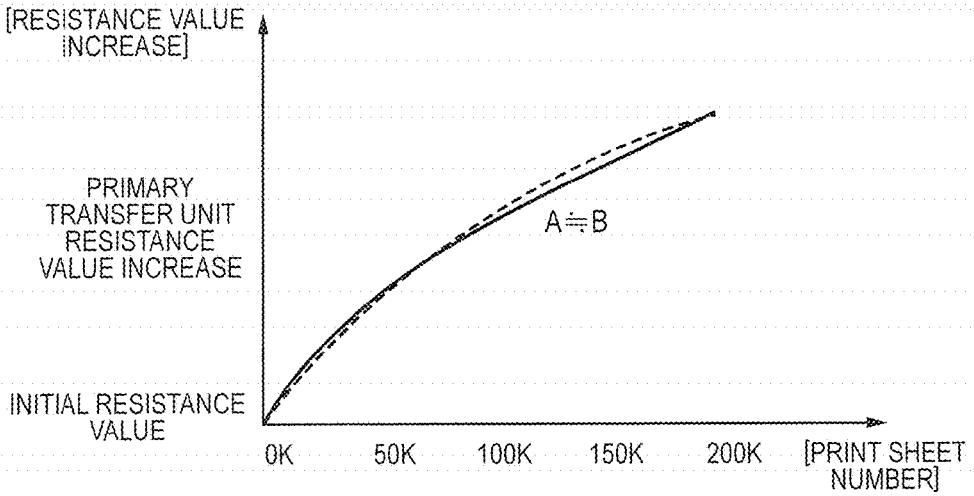
FIG. 6 is a graph illustrating an example of a detection result of the electric resistance value of a primary transfer portion.

FIG. 6 is a graph illustrating an example of transition of the detection result of the electric resistance value of the primary transfer portion N1 with increase in amount of use (printing sheet number) of the intermediate transfer unit 50. FIG. 6 illustrates the detection result of the electric resistance value of the primary transfer portion N1 in the case where the two types of transfer members S that are the transfer member A and the transfer member B and are the same as the members in the case in FIG. 5 are used. It was assumed that the conditions other than the condition of the transfer member S were substantially identical to the conditions in the case where any transfer member S was adopted.

FIG. 6 demonstrates that the detection result of the electric resistance value of the primary transfer portion N1 has a smaller difference in transition of the electric resistance value due to the difference in transfer member S than the difference the detection result of the electric resistance value of the secondary transfer portion N2 illustrated in FIG. 5 does, and the former is resistant to being affected by the condition where the image forming apparatus 100 is used. That is, the primary transfer roller is disposed in the intermediate transfer belt 8. Consequently, the variation in electric resistance value due to adhesion of paper powder is relatively small. It can be regarded that even though the adverse effect due to the paper powder adhering to the intermediate transfer belt 8 causes the adverse effect of variation in electric resistance value to some extent, the adverse effect is significantly small in comparison with the adverse effect of variation in the electric resistance value of the secondary transfer portion N2. Here, the detection result of the electric resistance value of the primary transfer portion N1 is the detected total resistance value of the electric resistance component of the primary transfer roller 5 and the electric resistance component of the intermediate transfer belt 8. However, the detection result of the electric resistance value of the primary transfer portion N1 has a smaller number of uncertainty elements, such as the effect of the transfer member S (the resistance value, basis weight, paper sheet size, and amount of paper powder) than the number of uncertainty elements the detection result of the electric resistance value of the secondary transfer portion N2 does. Consequently, the electric resistance value can be detected in a relatively stable manner.

Preferably, the electric resistance value of the primary transfer roller 5 is sufficiently low in comparison with the electric resistance value of the intermediate transfer belt 8 (for example, the volume resistivity is lower by at least two digits ($10^2$ Ω·cm) or more). In this case, the electric resistance value of the primary transfer portion N1 substantially only contains the electric resistance component of the intermediate transfer belt 8. Consequently, it can be considered that the detection result of the electric resistance value of the primary transfer portion N1 is substantially the detection of the electric resistance value of the intermediate transfer belt 8. For example, in order to set the electric resistance value of the primary transfer roller 5 to be substantially low in comparison with the electric resistance value of the intermediate transfer belt 8, the electronically conductive primary transfer roller 5 can be adopted. A metal roller that is a roller formed from metal is adopted as the primary transfer roller 5. In this case, the detection result of the electric resistance value of the primary transfer portion N1 can be regarded substantially as the detection result of the electric resistance value of the intermediate transfer belt 8, and can be used for control.

In this embodiment, the primary transfer roller 5 that includes the conductive elastic layer containing the conductive agent having electronic conductivity is adopted as the primary transfer roller 5. The electric resistance value of the primary transfer roller 5 is set to be sufficiently low in comparison with the electric resistance value of the intermediate transfer belt 8. Accordingly, in this embodiment, the detection result of the electric resistance value of the primary transfer portion N1 can be regarded substantially as the detection result of the electric resistance value of the intermediate transfer belt 8, and can be used for control. In this embodiment, the electric resistance value of the secondary transfer roller 11 is obtained by subtracting the detection result of the electric resistance value of the primary transfer portion N1 (the intermediate transfer belt 8) from the detection result of the electric resistance value of the secondary transfer portion N2. The life of the secondary transfer roller 11 is determined based on the variation in the obtained electric resistance value of the secondary transfer roller 11 from the value in the brand-new state of the secondary transfer roller 11.

Figure 7:
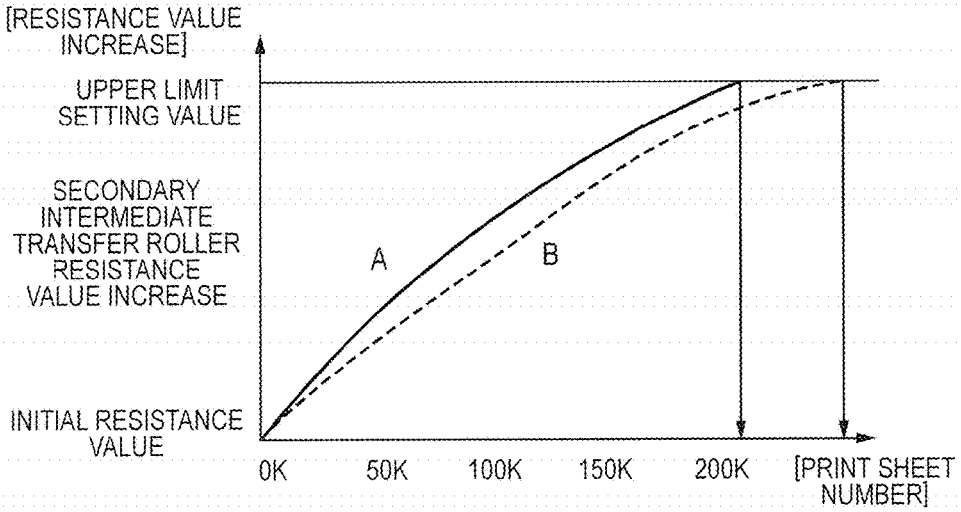
FIG. 7 is a graph illustrating an example of a detection result of the electric resistance value of a secondary transfer roller.

FIG. 7 is a graph illustrating the transition of the electric resistance value of the secondary transfer roller 11 obtained by subtracting the detection result (FIG. 6) of the electric resistance value of the primary transfer portion N1 from the detection result (FIG. 5) of the electric resistance value of the secondary transfer portion N2 at each detection timing.

The subtraction of the detection result of the electric resistance value of the primary transfer portion N1 from the detection result of the electric resistance value of the secondary transfer portion N2 allows the adverse effect of the variation in the electric resistance value of the intermediate transfer belt 8 to be reduced, and the variation in the electric resistance value of the secondary transfer roller 11 itself to be detected. This detection eliminates the need to secure the margin for the variation in the electric resistance value of the intermediate transfer belt 8. Consequently, the increase in the electric resistance value corresponding to the margin can be added to the upper limit setting value to widen the upper limit setting range (the solid line in FIG. 7). As a result, the timing from which it is determined that the secondary transfer roller 11 reaches the life can be delayed, and the number of printable sheets can be increased.

Figure 8:
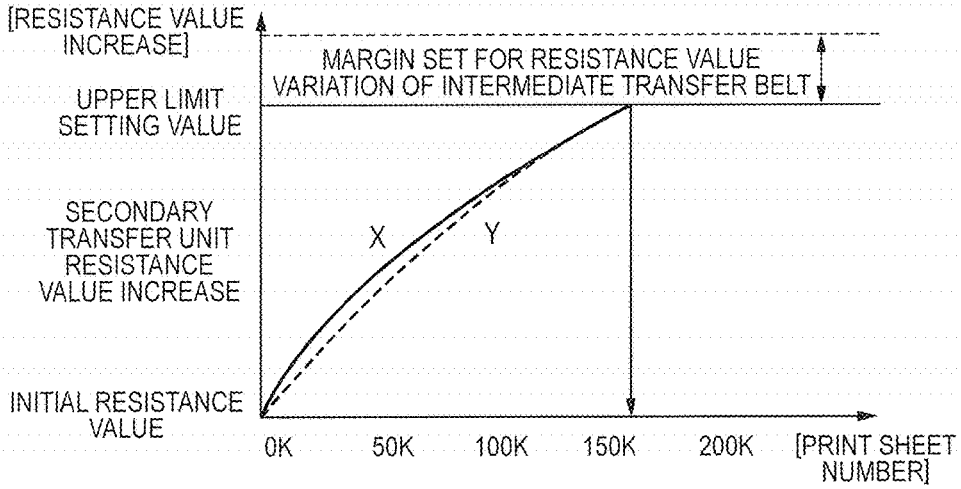
FIG. 8 is a graph illustrating another example of a detection result of the electric resistance value of the secondary transfer portion.

FIG. 8 is a graph illustrating the transition of the detection result of the electric resistance value of the secondary transfer portion N2 in an example other than the example illustrated in FIG. 5. FIG. 8 illustrates the detection results of two levels where the combinations of the electric resistance value of the intermediate transfer belt 8 and the electric resistance value of the secondary transfer roller 11 are different from each other so as to achieve the same combined resistance value of the electric resistance value of the intermediate transfer belt 8 and the electric resistance value of the secondary transfer roller 11. More specifically, X in the diagram indicates an example where the electric resistance value of the intermediate transfer belt 8 is relatively large and the electric resistance value of the secondary transfer roller 11 is relatively small. Y in the diagram indicates an example where the electric resistance value of the intermediate transfer belt 8 is relatively small and the electric resistance value of the secondary transfer roller 11 is large. FIG. 8 demonstrates that with a certain combination of the electric resistance value of the intermediate transfer belt 8 and the electric resistance value of the secondary transfer roller 11, the detection result of the electric resistance value of the secondary transfer portion N2 traces the analogous transition of the detection result of the electric resistance value.

Figure 9:
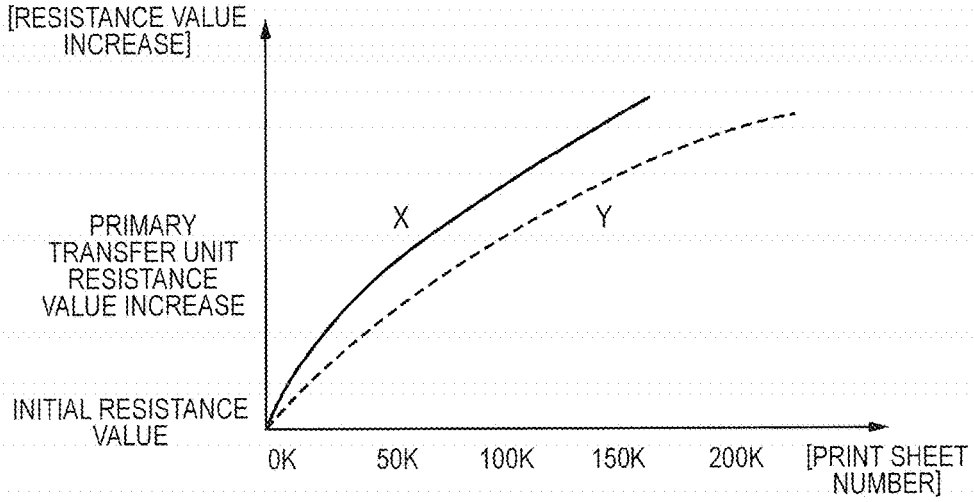
FIG. 9 is a graph illustrating another example of a detection result of the electric resistance value of the primary transfer portion.

FIG. 9 is a graph illustrating the transition of the detection result of the electric resistance value of the primary transfer portion N1 in the example of the two levels illustrated in FIG. 8. FIG. 9 demonstrates that even if the detection result of the electric resistance value of the secondary transfer portion N2 traces the analogous transition, X and Y have the different electric resistance values of the intermediate transfer belt 8, and resultantly the detection result of the electric resistance value of the primary transfer portion N1 traces different transition.

Figure 10:
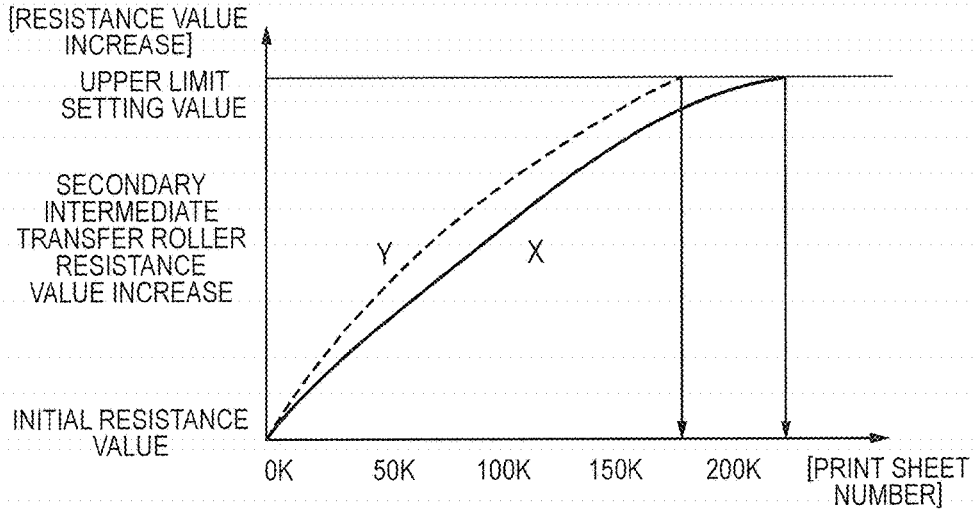
FIG. 10 is a graph illustrating another example of a detection result of the electric resistance value of the secondary transfer roller.

FIG. 10 is a graph illustrating the transition of the electric resistance value of the secondary transfer roller 11 obtained by subtracting the detection result (FIG. 9) of the electric resistance value of the primary transfer portion N1 from the detection result (FIG. 8) of the electric resistance value of the secondary transfer portion N2 at each detection timing, in the examples of the two levels illustrated in FIGS. 8 and 9. In the example of X, the electric resistance value of the intermediate transfer belt is relatively large, which demonstrates that if the detection result of the electric resistance value of the secondary transfer portion N2 is the same, the variation in the electric resistance value of the secondary transfer roller 11 is relatively small. Consequently, the timing at which the upper limit setting value is reached is delayed. As described above, the subtraction of the detection result of the electric resistance value of the primary transfer portion N1 from the detection result of the electric resistance value of the secondary transfer portion N2 allows recognition of the variation in the electric resistance value of the secondary transfer roller 11 itself, of which the difference cannot be discriminated only from the detection result of the electric resistance value of the secondary transfer portion N2. Accordingly, the timing from which it is determined that the secondary transfer roller 11 reaches the life can be delayed, and the number of printable sheets can be increased.

Figure 11:
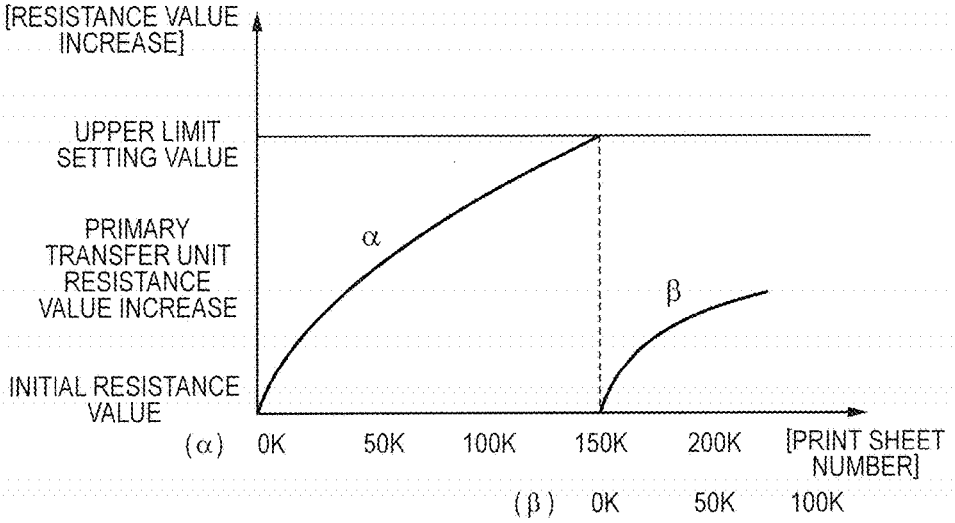
FIG. 11 is a graph illustrating an example of a detection result of the electric resistance value of the primary transfer portion in a case where an intermediate transfer unit is replaced.
Figure 12:
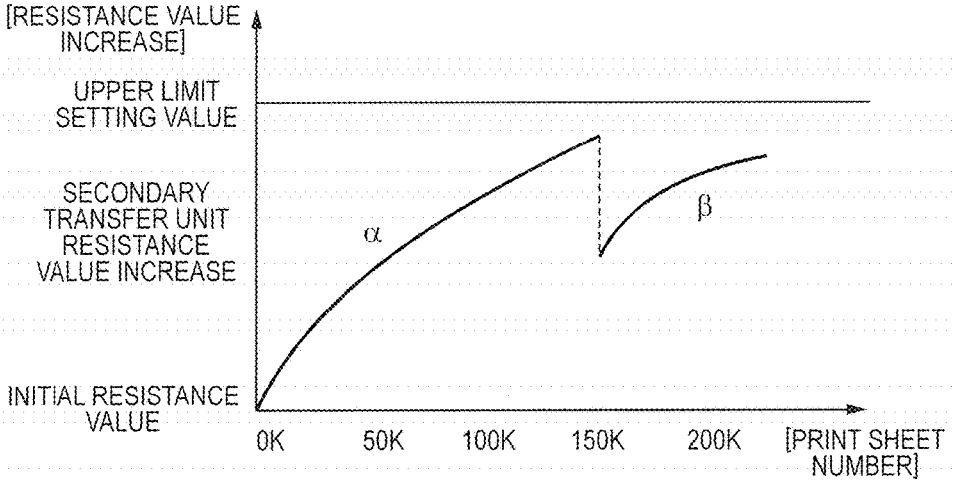
FIG. 12 is a graph illustrating an example of a detection result of the electric resistance value of the secondary transfer portion in a case where an intermediate transfer unit is replaced.
Figure 13:
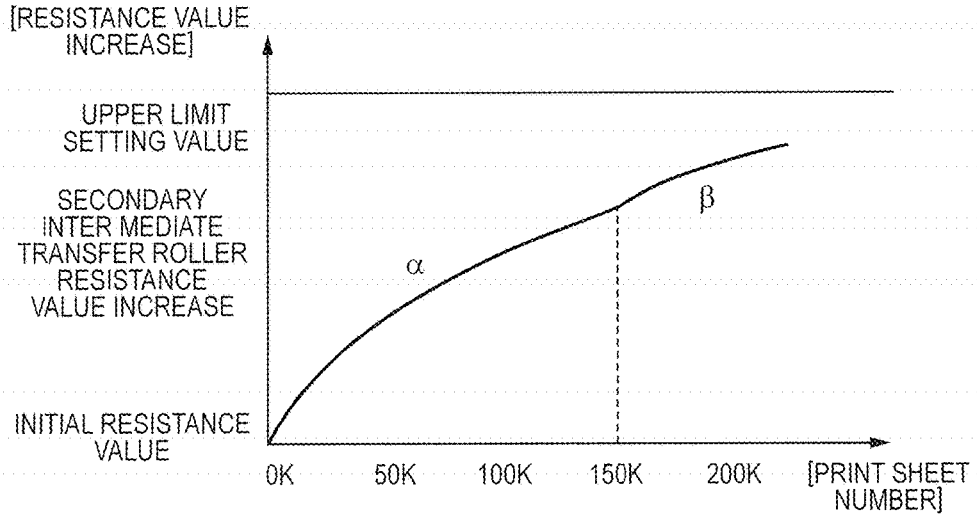
FIG. 13 is a graph illustrating an example of a detection result of the electric resistance value of the secondary transfer roller in a case where an intermediate transfer unit is replaced.

Next, referring to FIGS. 11 to 13, an example is described where the intermediate transfer unit 50 and the secondary transfer roller 11 are separately replaced in the apparatus main body 110. Here, the example is described where the intermediate transfer unit 50 (intermediate transfer belt 8) reaches the life earlier than the secondary transfer roller 11 does, and the intermediate transfer unit 50 (intermediate transfer belt 8) is replaced in the middle of the life period of the secondary transfer roller 11.

In this embodiment, the life of the intermediate transfer unit 50 is determined based on the detection result of the electric resistance value of the primary transfer portion N1. More specifically, the remaining life is obtained assuming that the remaining life in a case where the electric resistance value of the primary transfer portion N1 (intermediate transfer belt 8) is the initial resistance value is 100% and the remaining life in a case where the variation in electric resistance value from the initial resistance value reaches the preset upper limit setting value of the preset variation range is 0%. In this embodiment, the detection of the electric resistance value of the primary transfer portion N1 for determining the life of the intermediate transfer unit 50 is performed in a manner analogous to the manner in which the detection of the electric resistance value of the primary transfer portion N1 for determining the life of the secondary transfer roller 11 is performed. In particular, in this embodiment, the operation of detecting the electric resistance value of the primary transfer portion N1 for determining the lives of the secondary transfer roller 11 and the intermediate transfer unit 50 is performed in a shared manner. Likewise, the timings at which the pieces of information on the lives of the secondary transfer roller 11 and the intermediate transfer unit 50 are notified in a shared manner.

FIG. 11 is a graph illustrating an example of the transition of the detection result of the electric resistance value of the primary transfer portion N1 in a case where an intermediate transfer unit 50 is replaced. In the diagram, $\alpha$ indicates the detection result before replacement, and $\beta$ indicates the detection result after replacement. As illustrated in FIG. 11, the replacement of the intermediate transfer unit 50 differentiates between the detection results of the electric resistance value of the primary transfer portion N1 before and after the replacement. In the example illustrated in FIG. 11, at a time point when the amount of use (printing sheet number) of the intermediate transfer unit 50 (intermediate transfer belt 8) is about 150 K, the variation in the electric resistance value of the primary transfer portion N1 reaches the upper limit setting value, and it is determined that the intermediate transfer unit 50 reaches the life. The replacement of the intermediate transfer unit 50 causes the remaining life of the intermediate transfer unit 50 to be reset to 100%, and a new remaining life is consecutively detected after the replacement timing. On the other hand, the entire and the secondary transfer roller 11 of the image forming apparatus 100 do not reach the lives. Consequently, the remaining life is continuously subjected to consecutive detection.

FIG. 12 is a graph illustrating the transition of the detection result of the electric resistance value of the secondary transfer portion N2 in the example illustrated in FIG. 11. As illustrated in FIG. 12, when the intermediate transfer unit 50 is replaced in the middle of the life period of the secondary transfer roller 11, the electric resistance values of the primary transfer portion N1 become different from each other before and after the replacement of the intermediate transfer unit 50, and resultantly the detection result of the electric resistance value of the secondary transfer portion N2 traces a discontinuous transition. Consequently, it is difficult to determine the life of the secondary transfer roller 11 only from the detection result of the electric resistance value of the secondary transfer portion N2.

FIG. 13 is a graph illustrating the transition of the electric resistance value of the secondary transfer roller 11 obtained by subtracting the detection result (FIG. 11) of the electric resistance value of the primary transfer portion N1 from the detection result (FIG. 12) of the electric resistance value of the secondary transfer portion N2 at each detection timing, in the examples illustrated in FIGS. 11 and 12. As illustrated in FIG. 13, the subtraction of the detection result of the electric resistance value of the primary transfer portion N1 from the detection result of the electric resistance value of the secondary transfer portion N2 allows the variation in the electric resistance value caused by the replacement of the intermediate transfer unit 50 (intermediate transfer belt 8) to be corrected. Accordingly, the continuous increase in the electric resistance value of the secondary transfer roller 11 with the effect of the replacement of the intermediate transfer unit 50 (intermediate transfer belt 8) being reduced can be detected, and the life of the secondary transfer roller 11 can be more correctly determined.

As described above, the image forming apparatus 100 of this embodiment includes a detection unit that obtains information with regard to the life of the secondary transfer roller 11 based on the variation in the electric resistance value of the secondary transfer portion N2. In this embodiment, the CPU 26 of the control unit 25 has the function as the detection unit. The detection unit 26 performs the following process based on the detection result of information with regard to the electric resistance value of the secondary transfer portion N2 and the detection result of information with regard to the electric resistance value of the primary transfer portion N1. That is, the process is for reducing the effect of the variation in the electric resistance value of the intermediate transfer belt 8, the variation being contained in the variation in the electric resistance value of the secondary transfer portion N2. The detection unit 26 then obtains information with regard to the life of the secondary transfer roller 11 based on the result of the process. In particular, in this embodiment, the detection unit 26 performs the process of obtaining the information with regard to the electric resistance value of the secondary transfer roller 11, as the process described above. This process is performed by subtracting the electric resistance value of the intermediate transfer belt 8 obtained based on the detection result of information with regard to the electric resistance value of the primary transfer portion N1, from the detection result of information with regard to the electric resistance value of the secondary transfer portion N2. The detection unit 26 then obtains the information with regard to the life of the secondary transfer roller 11 by comparing the result of the process with a predetermined threshold.

4-3. Procedures of Life Detection Control

Figure 14:
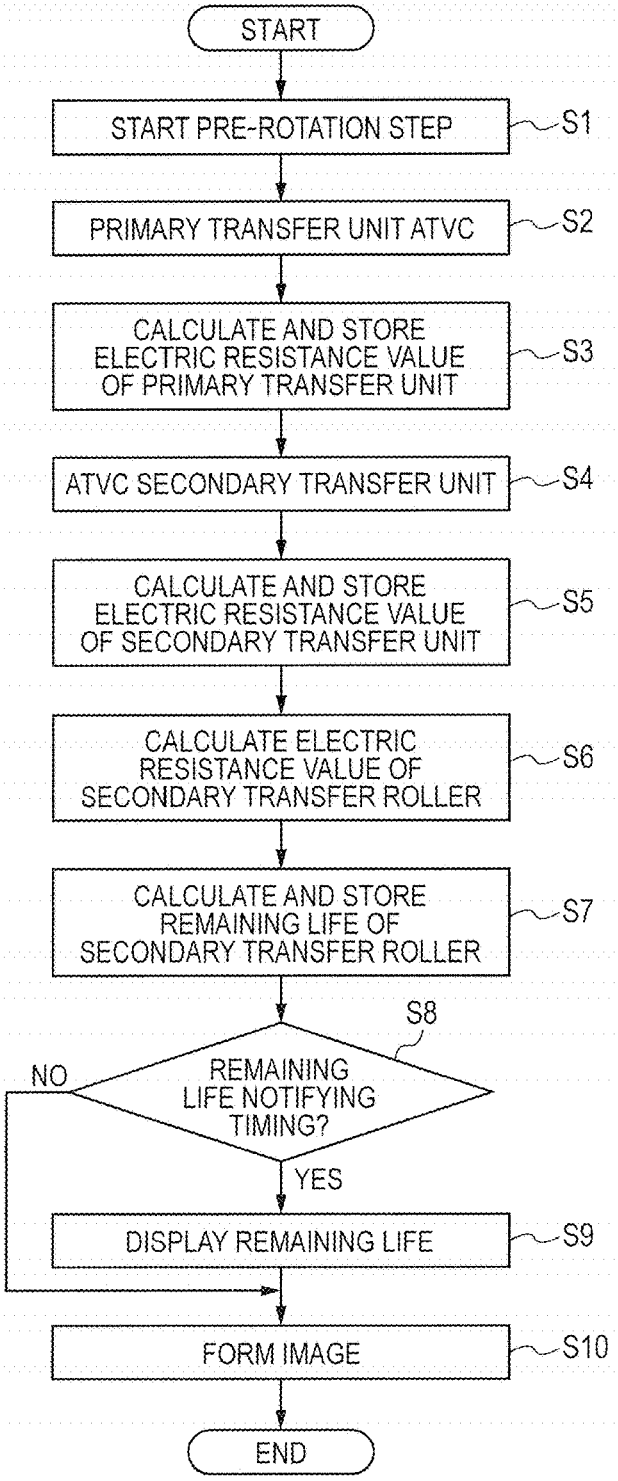
FIG. 14 is a flowchart for illustrating the procedures of life detection control.

Next, an example of the procedures of life detection control of the secondary transfer roller 11 in this embodiment is described. FIG. 14 is a flowchart illustrating an example of the procedures of a job that contains the life detection control of the secondary transfer roller 11 in this embodiment. Here, the life of the secondary transfer roller 11 is determined based on the relationship between the current and voltage in the secondary transfer portion N2 and the primary transfer portion N1 obtained by ATVC executed in the pre-rotation step of the job, and information with regard to the life is notified for every predetermined printing sheet number.

Upon acceptance of the job, the CPU 26 starts the rotations of the photosensitive drum 1 and the intermediate transfer belt 8 to start the pre-rotation step (S1). After the rotations of the photosensitive drum 1 and the intermediate transfer belt 8 become stable, the CPU 26 executes the ATVC of the primary transfer portion N1, determines the primary transfer voltage value during image formation, and stores the value in the memory 27 (S2). The CPU 26 obtains the electric resistance value of the primary transfer portion N1 based on the target current value in the ATVC of the primary transfer portion N1 in S2 and the output voltage value (average value) during constant current control at the target current value, and stores the value in the memory 27 (S3). The CPU 26 executes the ATVC of the secondary transfer portion N2, determines the secondary transfer voltage value during image formation, and stores the value in the memory 27 (S4). The CPU 26 obtains the electric resistance value of the secondary transfer portion N2 based on the target current value in the ATVC of the secondary transfer portion N2 in S4 and the output voltage value (average value) during constant current control at the target current value, and stores the value in the memory 27 (S5).

Next, the CPU 26 obtains the electric resistance value of the secondary transfer roller 11 by subtracting the electric resistance value of the primary transfer portion N1 obtained in S3 from the electric resistance value of the secondary transfer portion N2 obtained in S5, and obtains the variation in the electric resistance value from the initial resistance value of the electric resistance value (S6). A value obtained by subtracting the electric resistance value of the primary transfer portion N1 from the electric resistance value of the secondary transfer portion N2 detected first when the use of the secondary transfer roller 11 is started is stored as the initial resistance value in the memory 27. The CPU 26 compares the variation obtained in S6 with the upper limit setting value, obtains the current information with regard to the life of the secondary transfer roller 11 (the remaining life in this embodiment), and stores the information in the memory 27 (S7). The upper limit setting value is preliminarily stored in the memory 27.

Next, the CPU 26 determines whether the timing at which the information with regard to the life of the secondary transfer roller 11 (the remaining life in this embodiment) is notified is reached or not (S8). In this embodiment, it is determined whether the printing sheet number accumulated and stored in the memory 27 every time the image is output reaches a predetermined threshold (e.g., 100) or not, and if the number is reached, it is determined that the timing is the timing at which the information with regard to the life of the secondary transfer roller 11 is notified. In S8, if it is determined that the timing is the timing at which the information with regard to the life of the secondary transfer roller 11 is notified ("Yes" in S8), the CPU 26 causes the operation unit 29 to display the information with regard to the life of the secondary transfer roller 11 obtained in S7 (S9). Subsequently, upon completion of the predetermined pre-rotation step, the CPU 26 starts image formation (S10). On the contrary, if it is determined that the timing is not the timing at which the information with regard to the life of the secondary transfer roller 11 is notified in S8, the CPU 26 does not allow display of the information with regard to the life of the secondary transfer roller 11, and starts image formation upon completion of the predetermined pre-rotation step (S10).

In S9, display for recommending replacement of the secondary transfer roller 11 may be performed if the remaining life reaches 0%, or display for recommending preparation of replacement of the secondary transfer roller 11 may be performed if the remaining life approaches 0% (e.g., the remaining life of 10%). Instead of or in addition to the notification of the remaining life at every predetermined timing, the operation unit 29 may display recommendation of replacement of the secondary transfer roller 11 if the remaining life reaches 0%, or a warning of recommending preparation of replacement if the remaining life reaches 0% (e.g. the remaining life of 10%).

In this embodiment, the display unit of the operation unit 29 provided for the apparatus main body 110 is adopted as a notification unit for notifying the information with regard to the life of the secondary transfer roller 11. However, the configuration is not limited to this example. As illustrated in FIG. 15, the control unit 25 allows a communication unit 34 as a communicating unit to transmit the information with regard to the life of the secondary transfer roller 11 to an external device 200, such as a personal computer, outside the image forming apparatus 100, and allows the display unit of the external device 200 to display the information. The information with regard to the life of the secondary transfer roller 11 is not limited to display of characters. Alternatively, a notification can be issued to the operator through any method, such as audio or lighting (blinking) of a lamp. Alternatively, the information with regard to the life of the secondary transfer roller 11 may be displayed on the operation unit 29 of the apparatus main body 110 or the display unit of the external device 200 according to the instruction by the operator from the operation unit 29 provided for the apparatus main body 110 or the operation unit of the external device 200.

As described above, according to this embodiment, the accuracy of the determination of the life of the secondary transfer roller 11 is improved, which allows the secondary transfer roller 11 to be replaced at a more appropriate time. This configuration can maintain the output of a favorable image and reduce the maintenance cost.

[Other Embodiments]

The present invention has thus been described with reference to the specific embodiments. However, the present invention is not limited to the embodiments described above.

In the embodiments described above, the life of the secondary transfer roller is determined based on the electric resistance value of the secondary transfer roller obtained by subtracting the detection result of the electric resistance value of the primary transfer portion from the detection result of the electric resistance value of the secondary transfer portion. However, the present invention is not limited to such modes. It is only required to reduce the effect of the variation in the electric resistance value of the intermediate transfer belt that is contained in the variation in the electric resistance value of the secondary transfer portion and is obtained (estimated) from the detection result of the electric resistance value of the primary transfer portion.

For example, the correction coefficient and the like for correcting the detection result of the electric resistance value of the secondary transfer portion can be obtained based on the detection result of the electric resistance value of the primary transfer portion, and reflected in the determination result of the life of the secondary transfer roller. More specifically, the following control can be performed. For example, in a case where the secondary transfer roller and the intermediate transfer unit can be individually replaced in the apparatus main body, replacement with the intermediate transfer unit of which intermediate transfer belt has an initial resistance value largely different from the value of the intermediate transfer unit before replacement, in the middle of the life period of the secondary transfer roller, can be considered. In this case, in the conventional method, the relatively large margin is set for the upper limit setting value of the electric resistance value of the secondary transfer portion, in consideration of the variation in the electric resistance value of the intermediate transfer belt due to the replacement of the intermediate transfer unit. On the contrary, according to the present invention, it can be determined whether the electric resistance value of the intermediate transfer belt in the intermediate transfer unit mounted on the apparatus main body is relatively large or relatively small based on the detection result of the electric resistance value of the primary transfer portion. Multiple correction coefficients applied to the electric resistance value of the secondary transfer portion can be obtained in conformity with the electric resistance value of the primary transfer portion (for every predetermined electric resistance value range). In a case where the electric resistance value of the primary transfer portion is relatively large, the correction coefficient for correcting the electric resistance value of the secondary transfer roller predicted from the electric resistance value of the secondary transfer portion in a relatively reducing direction is applicable to the detection result of the electric resistance value of the secondary transfer portion. In this case, the application can be made because the electric resistance component of the intermediate transfer belt in the electric resistance value of the secondary transfer portion is relatively large, and the electric resistance component of the secondary transfer roller is relatively small. On the contrary, in a case where the electric resistance value of the primary transfer portion is relatively small, the correction coefficient for correcting the electric resistance value of the secondary transfer roller predicted from the electric resistance value of the secondary transfer portion in a relatively increasing direction is applicable to the detection result of the electric resistance value of the secondary transfer portion. In this case, the application can be made because the electric resistance component of the intermediate transfer belt in the electric resistance value of the secondary transfer portion is relatively small, and the electric resistance component of the secondary transfer roller is relatively large. Accordingly, the margin corresponding to the variation in the electric resistance value of the intermediate transfer belt set for the upper limit setting value of the electric resistance value of the secondary transfer roller can be reduced, and the life state due to the variation in the electric resistance value of the secondary transfer roller can be relatively accurately detected.

The effect of the variation in the electric resistance value of the intermediate transfer belt in the variation in the electric resistance value of the secondary transfer portion may be determined using the detection result of the life state of the intermediate transfer unit obtained based on the detection result of the electric resistance value of the primary transfer portion, and the effect may be reflected in the determination result of the life of the secondary transfer roller. More specifically, the following control can be performed. As described above, the electric resistance value of the primary transfer portion has a smaller number of uncertainty elements, such as the effect of the transfer member, than the number of uncertainty elements in the case of the electric resistance value of the secondary transfer portion, and can be relatively stably detected. Accordingly, the life state of the intermediate transfer unit can be relatively accurately obtained based on the detection result of the electric resistance value of the primary transfer portion. The transition of the electric resistance value of the intermediate transfer belt from the initial stage of use of the intermediate transfer unit to the life can be easily preliminarily predicted. Consequently, the preliminary acquisition of the relationship between the life state of the intermediate transfer unit and the electric resistance value of the intermediate transfer belt allows the electric resistance value of the intermediate transfer belt according to the current life state of the intermediate transfer unit to be relatively accurately predicted, based on the detection result of the electric resistance value of the primary transfer portion. Accordingly, the detection result of the electric resistance value of the secondary transfer portion can be corrected so as to reduce the effect of the electric resistance value of the intermediate transfer belt in the detection result of the electric resistance value of the secondary transfer portion, based on the prediction result of the electric resistance value of the intermediate transfer belt. Typically, subtraction of the prediction result of the electric resistance value of the intermediate transfer belt from the detection result of the electric resistance value of the secondary transfer portion allows the electric resistance value of the secondary transfer roller to be relatively accurately obtained. Alternatively, the correction coefficient that is analogous to the coefficient described above can be preliminarily obtained for each segment of the electric resistance value of the intermediate transfer belt in conformity with the life state of the intermediate transfer unit. According to the life state of the intermediate transfer unit obtained based on the detection result of the electric resistance value of the primary transfer portion, the correction coefficient can be applied to the detection result of the electric resistance value of the secondary transfer portion to correct the electric resistance value of the secondary transfer portion.

The process of reducing the effect of the variation in the electric resistance value of the intermediate transfer belt contained in the variation in the electric resistance value of the secondary transfer portion is not limited to the adjustment of the information with regard to the electric resistance value of the secondary transfer portion (operations, such as the subtraction of the detection result of the electric resistance value, and the multiplication of the correction coefficient). Analogous results can be obtained by adjusting the threshold (upper limit setting value) with which the electric resistance value of the secondary transfer portion is compared. For example, in a case where it is determined that the electric resistance component of the intermediate transfer belt in the electric resistance value of the secondary transfer portion is relatively large based on the detection result of the electric resistance value of the primary transfer portion, the threshold may be corrected in a direction of being relatively increased. On the contrary, in a case where it is determined that the electric resistance component of the intermediate transfer belt in the electric resistance value of the secondary transfer portion is relatively small based on the detection result of the electric resistance value of the primary transfer portion, the threshold may be corrected in a direction of being relatively reduced. Accordingly, the margin of the variation in the electric resistance value of the intermediate transfer belt can be reduced in response to the actual electric resistance value of the secondary transfer roller based on the detection result of the electric resistance value of the primary transfer portion.

In the above embodiments, the case has been described where the electric resistance value of the primary transfer roller is sufficiently smaller than the electric resistance value of the intermediate transfer belt, and the detection result of the electric resistance value of the primary transfer portion is substantially the detection result of the electric resistance value of the intermediate transfer belt. However, the present invention is not limited to such modes. For example, in the mode of application of the correction coefficient, the electric resistance value of the intermediate transfer belt is only required to be predicted from the electric resistance value of the primary transfer portion. Even in a case where the detection result of the electric resistance value of the primary transfer portion contains the electric resistance component of the primary transfer roller to an unignorable extent, analogous control can be performed.

The information with regard to the electric resistance value is not limited to the electric resistance value itself. Any value having a correlation with the electric resistance value may be adopted. For example, in a case where any one of the current value and the voltage during detection of the information with regard to the electric resistance value is constant, the other may be adopted as the information with regard to the electric resistance value.

The information with regard to the life is not limited to the remaining life %. For example, the number of remaining printable sheets may be adopted as the information. The number of printable sheets can be predicted, based on the relationship between the current printing sheet number and life state, from the ratio of the reduction in remaining life % to the present printing sheet number.

In the above embodiments, the primary transfer member and the secondary transfer member are roller-shaped members. However, the configuration is not limited to this example. Any of the shapes, such as a pad, brush, and sheet, may be adopted. In the above embodiments, the intermediate transfer member is the endless belt. However, the configuration is not limited to this example. For example, a drum-shaped member stretched over a frame may be adopted. In the above embodiments, the secondary transfer member is attachable and detachable to and from the apparatus main body separately from the intermediate transfer member. For example, a form of the intermediate transfer unit may be adopted to allow the secondary transfer member to be attached and detached to and from the apparatus main body integrally with the intermediate transfer member (and further the primary transfer member).

In the above embodiments, the electric resistance value of the secondary transfer portion and the electric resistance value of the primary transfer portion are detected in the pre-rotation step, which is the non-image formation time. The detection is not limited to this example. Alternatively, the detection may be performed in any of the pre-multi-rotation step, post-rotation step, inter-sheet step and the like. As in the above embodiments, the life of the secondary transfer member is typically determined based on the electric resistance value of the secondary transfer portion detected during the same non-image formation time (the same pre-rotation step) and the electric resistance value of the primary transfer portion. The determination is not limited to this example. For example, the electric resistance value of the secondary transfer portion and the electric resistance value of the primary transfer portion may be detected in different pre-rotation steps, or detected respectively in the pre-rotation step and the inter-sheet step (or post-rotation step). In a range of capable of determining the life of the secondary transfer member at a desired accuracy, the electric resistance value of the secondary transfer portion and the electric resistance value of the primary transfer portion may be detected at different timings.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-008551, filed Jan. 20, 2017, which is hereby incorporated by reference herein in its entirety.

What is claimed is:

1. An image forming apparatus comprising:

an image bearing member configured to bear a toner image;

an intermediate transfer member configured to convey the toner image primarily transferred from the image bearing member for secondary transfer onto a transfer material;

a primary transfer member configured to primarily transfer the toner image from the image bearing member onto the intermediate transfer member at a primary transfer portion;

a secondary transfer member configured to secondarily transfer the toner image from the intermediate transfer member onto the transfer material at a secondary transfer portion;

a first power supply configured to apply a voltage to the primary transfer member;

a second power supply configured to apply a voltage to the secondary transfer member;

a first detection unit configured to detect information based on a current value and a voltage value in a case of application of the voltage to the primary transfer member by the first power supply;

a second detection unit configured to detect information based on a current value and a voltage value in a case of application of the voltage to the secondary transfer member by the second power supply; and a detection unit configured to obtain information with regard to the secondary transfer member based on a detection result by the second detection unit, wherein the detection unit takes advantage of a detection result by the first detection unit to obtain the information with regard to the secondary transfer member.

2. An image forming apparatus according to claim 1, wherein the first detection unit detects information with regard to an electric resistance value of the primary transfer portion based on the current value and the voltage value in the case of application of the voltage to the primary transfer member by the first power supply.

3. An image forming apparatus according to claim 2, wherein the second detection unit detects information with regard to an electric resistance value of the secondary transfer portion based on the current value and the voltage value in the case of application of the voltage to the secondary transfer member by the second power supply.

4. An image forming apparatus according to claim 3, wherein the detection unit performs reduction processing to reduce an effect of a variation in an electric resistance value of the intermediate transfer member contained in a variation in the electric resistance value of the secondary transfer portion to obtain the information with regard to a life of the secondary transfer member.

5. An image forming apparatus according to claim 4, wherein the reduction processing includes detection processing of obtaining information with regard to the electric resistance value of the secondary transfer member by subtracting an amount corresponding to the electric resistance value of the intermediate transfer member obtained based on the detection result by the first detection unit from the detection result by the second detection unit, to obtain the information with regard to the life of the secondary transfer member by comparing a result of the detection processing with a predetermined threshold.

6. An image forming apparatus according to claim 4, wherein the reduction processing includes correction processing of correcting the detection result by the second detection unit according to the detection result by the first detection unit, to obtain the information with regard to the life of the secondary transfer member by comparing a result of the correction processing with a predetermined threshold.

7. An image forming apparatus according to claim 4, wherein the reduction processing includes correction processing of correcting the detection result by the second detection unit according to a life state of the intermediate transfer member obtained based on the detection result by the first detection unit, to obtain the information with regard to the life of the secondary transfer member by comparing a result of the correction processing with a predetermined threshold.

8. An image forming apparatus according to claim 4, wherein the detection unit is configured to obtain a remaining life of the secondary transfer member by comparing the detection result by the second detection unit with a predetermined threshold, wherein the reduction processing includes correction processing of correcting the threshold according to the detection result by the first detection unit, as the reduction processing.

9. An image forming apparatus according to claim 1, comprising a notification unit configured to notify information, wherein the detection unit causes the notification unit to notify the information with regard to the secondary transfer member.

10. An image forming apparatus according to claim 1, comprising a communicating unit that transmits information to an external device outside the image forming apparatus, wherein the detection unit causes the communicating unit to transmit the information with regard to the secondary transfer member to the external device.

11. An image forming apparatus according to claim 1, wherein an electric resistance value of the intermediate transfer member is larger than an electric resistance value of the primary transfer member.

12. An image forming apparatus according to claim 1, wherein the primary transfer member has electronic conductivity.

13. An image forming apparatus according to claim 1, wherein the primary transfer member is formed from metal.

14. An image forming apparatus comprising:

an image bearing member configured to bear a toner image;

an intermediate transfer member configured to convey the toner image having been primarily transferred from the image bearing member for secondary transfer onto a transfer material;

a primary transfer member configured to primarily transfer the toner image from the image bearing member onto the intermediate transfer member at a primary transfer portion;

a secondary transfer member configured to secondarily transfer the toner image from the intermediate transfer member onto the transfer material at a secondary transfer portion;

a first power supply configured to apply a voltage to the primary transfer member;

a second power supply configured to apply a voltage to the secondary transfer member;

a first detection unit configured to detect information based on a current value and a voltage value in a case of application of the voltage to the primary transfer member by the first power supply;

a second detection unit configured to detect information based on a current value and a voltage value in a case of application of the voltage to the secondary transfer member by the second power supply; and a notification unit configured to notify information, wherein the notification unit is configured to notify the information with regard to the life of the secondary transfer member according to results by the first detection unit and the second detection unit.

15. An image forming apparatus comprising:

an image bearing member configured to bear a toner image;

an intermediate transfer member configured to convey the toner image primarily transferred from the image bearing member for secondary transfer onto a transfer material;

a primary transfer member configured to primarily transfer the toner image from the image bearing member onto the intermediate transfer member at a primary transfer portion;

a secondary transfer member configured to secondarily transfer the toner image from the intermediate transfer member onto the transfer material at a secondary transfer portion;

a first power supply configured to apply a voltage to the primary transfer member;

a second power supply configured to apply a voltage to the secondary transfer member;

a first detection unit configured to detect information based on a current value and a voltage value in a case of application of the voltage to the primary transfer member by the first power supply;

a second detection unit configured to detect information based on a current value and a voltage value in a case of application of the voltage to the secondary transfer member by the second power supply; and a communicating unit configured to transmit information to an external device outside the image forming apparatus, wherein the communicating unit is configured to transmit the information with regard to the life of the secondary transfer member to the external device according to results by the first detection unit and the second detection unit.

* * * * *